United States Patent [19]

Douthett et al.

[11] 4,341,555

[45] Jul. 27, 1982

[54] HIGH STRENGTH AUSTENITIC STAINLESS STEEL EXHIBITING FREEDOM FROM EMBRITTLEMENT

[75] Inventors: Joseph A. Douthett, Monroe; Harry Tanczyn, Middletown, both of Ohio

[73] Assignee: Armco Inc., Middletown, Ohio

[21] Appl. No.: 135,692

[22] Filed: Mar. 31, 1980

[51] Int. Cl.[3] ..... C22C 38/44; C22C 38/48; C22C 38/50; C22C 38/58

[52] U.S. Cl. ..... 75/128 A; 75/125; 75/128 G; 75/128 N; 75/128 W; 148/38

[58] Field of Search ..... 75/128 A, 128 N, 128 G, 75/128 W, 125; 148/38

[56] References Cited

U.S. PATENT DOCUMENTS

Re. 29,313 7/1977 Muta et al. ..... 75/128 W 3,592,634 7/1971 Denhard, Jr. et al. ..... 75/128 V 3,751,244 8/1973 Mimino et al. ..... 75/128 T

*Primary Examiner*—Michael L. Lewis

*Attorney, Agent, or Firm*—Frost & Jacobs

[57] ABSTRACT

An austenitic stainless steel having high strength, good hot workability, good corrosion resistance, and freedom from embrittlement both in the cold-worked and stress-relieved condition and in the heat affected zone of weldments, consisting essentially of 0.06% maximum carbon, about 0.2% to 3.0% manganese, about 21% to 24.5% chromium, about 10% to 17% nickel, about 0.15% to 0.40% nitrogen, about 1.5% maximum silicon, about 2% to 4.5% molybdenum, about 0.06% maximum phosphorus, about 0.35% maximum sulfur, residual columbium with less than about 0.04% carbon and about 0.1% to 0.6% columbium with carbon exceeding about 0.04%, and balance essentially iron.

6 Claims, No Drawings

HIGH STRENGTH AUSTENITIC STAINLESS STEEL EXHIBITING FREEDOM FROM EMBRITTLEMENT

BRIEF SUMMARY OF THE INVENTION

This invention relates to a chromium-nickel-molybdenum-nitrogen stainless steel having high strength, good hot workability, good resistance against intergranular, pitting and crevice corrosion, and freedom from embrittlement both in the cold-worked and stress-relieved condition and in the heat affected zone of weldments.

AISI Type 316 L is a low carbon modification of Type 316, having a nominal composition, in weight percent, of 0.03% maximum carbon, 2.00% maximum manganese, 16.00–18.00% chromium, 10.00–14.00% nickel, 2.00–3.00% molybdenum, and remainder essentially iron.

AISI Type 309 S has a nominal composition of 0.08% maximum carbon, 2.00% maximum manganese, 22.00–24.00% chromium, 12.00–15.00% nickel, and remainder essentially iron.

U.S. Pat. No. 3,592,634 issued July 13, 1971 to E. E. Denhard, Jr. et al., discloses a stainless steel of high strength and corrosion resistance, consisting essentially of about 20.5% to 25% chromium, about 6% to about 17% nickel, about 3.5% to about 7% manganese, about 0.15% to about 0.50% nitrogen, at least two ingredients selected from the group consisting of molybdenum, columbium, and vanadium wherein molybdenum is about 0.5% to about 4%, columbium about 0.1% to about 0.7%, and vanadium about 0.05% to about 0.5%, with carbon less than 0.08%, silicon not exceeding about 0.7%, and remainder substantially all iron.

U.S. Pat. No. Re. 28,772 (a reissue of the above U.S. Pat. No. 3,592,634) issued Apr. 13, 1976, claims a stainless steel essentially consisting of about 20.5% to 25% chromium, about 6% to about 17% nickel, about 3.5% to about 7% manganese, about 0.15% to about 0.50% nitrogen, about 0.5% to about 4% molybdenum, about 0.05% to about 0.5% vanadium, with carbon about 0.03% to 0.06%, silicon not exceeding about 0.7% and remainder substantially all iron. Columbium is optionally present within the range of about 0.1% to about 0.7%. The tensile and yield strengths of this steel are substantially higher than those of Types 309S and 316L.

British Pat. No. 1,142,582, published Feb. 12, 1969, discloses an austenitic stainless steel comprising up to 0.03% carbon, up to 1.0% silicon, 0.5 to 12% manganese, 16 to 28% chromium, 9 to 20% nickel, 0 to 4.0% copper, 1.5 to 6.0% molybdenum, 0.10 to 0.40% nitrogen, 0.10 to 0.40% niobium (columbium), and remainder iron with unavoidable impurities.

Other patents disclosing alloys of the present type include U.S. Pat. Nos. 2,453,598 and 2,839,392.

Although AISI Type 316L has been used for applications requiring good weldability and resistance against corrosion in reducing environments, its resistance against pitting in chloride media and its crevice corrosion resistance can be inadequate, and it has low mechanical strength.

Type 309S, although having good oxidation resistance and weldability, has poor corrosion resistance in reducing environments and has inadequate intergranular corrosion resistance, and it also has low mechanical strenght.

The steels of U.S. Pat. No. 3,592,634 and U.S. Pat. No. Re. 28,772 are susceptible to several forms of embrittlement as hereinafter described.

The steel of British Pat. No. 1,142,582 would exhibit adequate general corrosion resistance but has low mechanical strenght in comparison to the steel of U.S. Pat. No. Re. 28,772.

Despite the many stainless steels presently available, there is a definite need for a stainless steel combining good hot workability, high strength comparable to the steel of U.S. Pat. No. Re. 28,772, freedom from embrittlement, good resistance against intergranular, pitting and crevice corrosion, and good weldability.

It is the principal object of the present invention to provide an austenitic stainless steel exhibiting the above novel combination of properties.

It has been found that the above object is achieved in an alloy steel in which critical proportioning and relatively narrow percentage ranges of essential elements are observed, whereby to avoid formation of intermetallic compounds as a result of precipitation processes and/or exposure within a temperature range of about 260° to about 980° C., and to avoid occurrence of microstructures which can readily convert to epsilon phase, chi phase and/or sigma phase with consequent embrittlement, in cold worked and stress relieved products subjected to service temperatures of about 100° to 565° C., or about 595° to 870° C.

DETAILED DESCRIPTION

In broad ranges, the steel of the present invention consists essentially of, in weight percent, 0.06% maximum carbon, about 0.2% to 3.0% manganese, about 21% to 24.5% chromium, about 10% to 17% nickel, about 0.15% to 0.40% nitrogen, about 1.5% maximum silicon, about 2% to 4.5% molybdenum, about 0.06% maximum phosphorus, about 0.35% maximum sulfur, up to about 0.6% columbium, with residual columbium when carbon is less than about 0.04%, and with columbium ranging from about 0.1% to 0.6% when carbon exceeds about 0.04%, and balance essentially iron.

Residual columbium levels are defined, for purposes of the present invention, as equal to or less than 0.05% by weight.

Where free-machinability is not needed, a maximum of about 0.04% sulfur should be observed in the broad composition.

A preferred composition in accordance with the present invention consists essentially of, in weight percent, 0.06% maximum carbon, about 0.2% to 2.5% manganese, about 21.5% to 24.5% chromium, above 12% to about 16% nickel, about 0.20% to about 0.35% nitrogen, about 0.4% to about 0.7% silicon, about 2% to about 4% molybdenum, about 0.06% maximum phosphorus, about 0.04% maximum sulfur, up to about 0.6% columbium, with residual columbium when carbon is less than about 0.04% and columbium ranging from about 0.1% to 0.6% when carbon exceeds about 0.04%, and balance essentially iron. In the preferred embodiment wherein carbon ranges between greater than about 0.04% and 0.06% and columbium between about 0.1% and 0.6%, the formation of columbium carbides promotes a fine grain size (less than ASTM 6) and provides increased mechanical strength, particularly 0.2% tensile yield strength.

Where increased mechanical strength is not needed, a preferred composition in accordance with the invention consists essentially of, in weight percent, 0.03% maximum carbon, about 0.2% to 2.5% manganese, about 21.5% to 24.5% chromium, 12% to about 16% nickel, about 0.20% to about 0.35% nitrogen, about 0.4% to about 0.7% silicon, about 2% to about 3% molybdenum, about 0.06% maximum phosphorus, about 0.04% maximum sulfur, about 0.05% maximum columbium, and balance essentially iron.

As will be shown by test data, it is of critical importance to avoid formation of metallic compounds and incidence of epsilon phase in order to prevent embrittlement in the cold-worked and stress-relieved condition, and to avoid chi and/or sigma phases in the heat affected zone of a weldment. This is accomplished in the present invention by critical proportioning of the elements chromium, manganese and molybdenum.

Epsilon phase is a hexagonal, close-packed lattice structure, which will occur in some steels as a result of exposure to service temperature in the range of about 100° to 565° C.

While control of the proportioning among the elements can be assisted by calculating nickel and chromium equivalents in accordance with Hull's equations and by calculations of an austenite instability factor in accordance with an equation set forth in U.S. Pat. No. 3,599,320 (to K. B. Brickner et al), it must be recognized that even the less complex chromium-nickel austenitic stainless steels exhibit localized variations in chromium and nickel contents in thin wrought strip form. In the case of the molybdenum and nitrogen-containing steels of the present invention still further localized or segregated structures can result which are believed to be inherent in the solidification process for multi-component compositions. In the liquid state chemical elements develop "associations or bonds." The onset of solidification upon cooling occurs at points exhibiting the highest temperature of solidification, i.e., the less-alloyed compositions within the bulk liquid. Initial solidification enriches the remaining liquid in elements which function to depress the solidification temperature of the bulk liquid. This point-solidification sequence and subsequent change in composition of the remaining liquid metal continues to the completion of solidification. Subsequent processing of the cast metal to wrought forms does not completely homogenize the prior heterogeneous, as cast metal. By way of specific example, it has been found that a chromium-nickel austenitic stainless steel in strip form with an overall nickel content of 9.72% exhibited localized nickel contents as low as 8.4%, thus resulting in localized areas of delta ferrite which in a welding operation can be converted to chi phase and/or sigma phase with consequent embrittlement and decrease in corrosion resistance. Similarly, nitrogen-containing austenitic stainless steels are subject to segregation as a result of the depressing effect of nitrogen on the temperature of solidification.

Subject to the above precautions, proportioning of the essential elements of the present steel can be guided by controlling the nickel equivalent to a value between 16 and 19 as determined by Hull's equation:

$$\text{Ni Equiv.} = \%Ni + 0.11(\%Mn) - 0.0086(\%Mn)^2 + 0.41(Co) + 0.44(Cu) + 18.4(\%N) + 24.5(\%C)$$

Similarly the chromium equivalent preferably is controlled within the range of 24 to 27 as calculated by Hull's equation:

$$\text{Cr Equiv.} = \%Cr + 1.21(\%Mo) + 0.48(\%Si) + 2.27(\%V)$$

The instability factor, which is a measure of austenite stability, preferably will be controlled to a value of less than −14 as calculated by the equation:

$$\text{Inst.F.} = 37.19 - 51.25(\%C) - 2.59(\%Ni) - 1.02(\%Mn) - 0.47(\%Cr) - 34.4(\%N)$$

A nickel equivalent of at least 16 and a minimum nickel content of 10% are preferred in order to stabilize the austenite sufficiently that substantially no delta ferrite is present throughout the hot rolling stage. A maximum nickel equivalent of 19 and a maximum nickel content of 17% are believed to be of benefit in avoiding autogenous weld cracking.

The above relationships are effective within a chromium equivalent range of 24 to 27. This range is a function primarily of the chromium and molybdenum contents (since vanadium is restricted to residual levels), and is preferred in order to obtain good intergranular corrosion resistance.

An instability factor of less than −14 is preferred in order to avoid deformation martensite upon cold reduction. With carbon and manganese at relatively low levels, substantial nickel, chromium and nitrogen additions ensure that the instability factor is at the desired value.

A minimum of about 0.2% manganese is desired for its effect in stabilizing austenite. On the other hand it has been found that the time-temperature relationship for the appearance of chi phase and/or sigma phase in austenitic stainless steels, particularly where chromium exceeds about 23%, is affected by the manganese, silicon, molybdenum, nickel, carbon and nitrogen contents. Manganese accelerates and nickel inhibits the rate and extent of sigma phase formation. Silicon and molybdenum are similar to manganese in this respect, while carbon and nitrogen resemble nickel. Chi phase is a variant of sigma phase which may occur in molybdenum-enriched stainless steels. The low manganese level of the present steel provides resistance to the formation of chi and/or sigma phases, particularly in fabrication and joining operations such as welding, where the heat affected zones reach temperatures within the range of about 595° to about 870° C. Hence manganese is restricted to a broad maximum of 3.0% and preferably to 2.5% in the steel of the invention, in contrast to the 3.5% minimum manganese content of U.S. Pat. No. Re. 28,772.

Carbon is restricted to a maximum of 0.06% for good intergranular corrosion resistance.

Nitrogen is essential in an amount of at least about 0.15% minimum for its function as an austenite former and stabilizer, and inhibitor of chi and/or sigma phases. It also contributes to the high tensile and yield strengths. A broad maximum of 0.4%, and preferably about 0.35%, should be observed in order to avoid exceeding the solubility of nitrogen in molten steel.

Molybdenum within the range of about 2% to about 4.5% confers strength and resistance against pitting and crevice corrosion in chloride-containing environments.

Silicon, phosphorus and sulfur may be present in the amounts indicated in the above broad and preferred compositions without harmful effects. Copper may also be present in residual amounts up to about 0.75% maximum. Vanadium, tungsten and cobalt may also be present in residual quantities without adverse effects.

TABLE I

| Heat | C | Mn | P | S | Si | Cr | Ni | Mo | N | V | Cb |
|---|---|---|---|---|---|---|---|---|---|---|---|
| | Composition-Weight Percent | | | | | | | | | | |
| 08* | 0.015 | 2.21 | 0.006 | 0.013 | 0.40 | 22.32 | 13.05 | 2.27 | 0.35 | 0.02 | 0.01 |
| 66* | 0.014 | 1.88 | 0.004 | 0.013 | 0.51 | 21.24 | 13.40 | 2.12 | 0.31 | 0.09 | 0.01 |
| 67* | 0.026 | 1.92 | 0.006 | 0.014 | 0.50 | 21.06 | 13.48 | 2.12 | 0.26 | 0.16 | 0.13 |
| Comm'l Re.28,772 | 0.050 | 5.44 | 0.015 | 0.010 | 0.42 | 21.48 | 12.36 | 2.12 | 0.27 | 0.20 | 0.19 |

*Steels of the present invention

TABLE II

| Condition | Bend Tests Degree of Bend Angle Around 3/16 inch Diameter Mandrel | | | |
|---|---|---|---|---|
| | Heat 08 | Heat 66 | Heat 67 | Comm'l Re. 28,772 |
| As cold drawn (C.D.) | 180 | 180 | 180 | 180 |
| C.D.+260° C.-1 hour-air cooled | 180 | 180 | 180 | 45 cracked |
| C.D.+260° C.-4 hours-air cooled | 180 | 180 | 180 | 50 cracked |
| C.D.+260° C.-8 hours-air cooled | 180 | 180 | 180 | 50 cracked |
| C.D.+260° C.-16 hours-air cooled | 180 | 180 | 180 | 55 cracked |
| C.D.+371° C.-1 hour-air cooled | 180 | 180 | 180 | 34 cracked |
| C.D.+371° C.-4 hours-air cooled | 180 | 180 | 180 | 30 cracked |
| C.D.+371° C.-8 hours-air cooled | 180 | 180 | 180 | 32 cracked |
| C.D.+371° C.-16 hours-air cooled | 180 | 180 | 180 | 34 cracked |
| C.D.+482° C.-1 hour-air cooled | 180 | 180 | 180 | 45 cracked |
| C.D.+482° C.-4 hours-air cooled | 180 | 180 | 180 | 47 cracked |
| C.D.+482° C.-8 hours-air cooled | 180 | 180 | 180 | 44 cracked |
| C.D.+482° C.-16 hours-air cooled | 180 | 180 | 180 | 42 cracked |

In order to compare the steel of the present invention with that of U.S. Pat. No. Re. 28,772 from the standpoint of embrittlement of cold-drawn and stress-relieved wire sections, three heats were prepared in accordance with the present invention and tested along with a commercial heat made in accordance with U.S. Pat. No. Re. 28,772. All specimens were hot rolled from four inch square billet stock to ¼ inch diameter rod stock, and then to 0.125 inch diameter annealed and cold-drawn wire. Cold-drawn wire sections were stress-relieved at 260° C., 371° C. and 482° C., and bent over a 3/16 inch diameter mandrel to breakage or to 180° (flat-on-self). Ultimate tensile strengths of the wire sections were all within the range of 205 to 211 ksi. The compositions of these heats are set forth in Table I, and bend test results on sections as cold-drawn and as cold-drawn plus stress-relieved are set forth in Table II. It will be noted that all specimens were bent 180° without cracking in the as cold-drawn condition. However, in the cold-drawn and stress-relieved condition the steel of U.S. Pat. No. Re. 28,772 exhibited breakages at less than 60° bends whereas all the wire sections in accordance with the present invention successfully underwent 180° bends without cracking.

A similar problem was noted for the steel of U.S. Pat. No. Re. 28,772 for weldments made by a resistance butt-weld process. Hot reduced stock of about 1 inch diameter having a resistance butt-weld was subjected to a dilute sulfuric acid pickling medium for several months and was then subjected to examination. It was found that accelerated corrosion had occurred in an area about 3/32 inch wide centered on the weld interface. The progress of corrosion was through areas immediately adjacent the fusion zone, i.e. the heat affected zone. This area differed from other areas in the round stock in containing a relatively small percent of chi and/or sigma phase as a result of the welding operation, and this accounted for the accelerated corrosion.

A series of heats in accordance with the invention were melted and processed by conventional casting, hot rolling, annealing, descaling and cold rolling. The compositions of these heats are set forth in Table III.

Laboratory processing of one inch by three inch ingots involved hot rolling from 1288° C. (2350° F.) to 0.1 inch thickness, annealing at 1121° C. (2050° F.), descaling, cold rolling to four thicknesses with reduction in thickness of 20%, 40%, 50% and 60%. Material cold rolled 50% to 0.05" was annealed at 1065° C. (1950° F.).

Samples obtained after 50% cold reduction and annealing were subjected to room temperature tensile tests, potentiodynamic crevice corrosion tests and G.T.A. weldability.

The room temperature mechanical properties of the cold reduced and annealed samples of Table III are set forth in Table IV together with chromium equivalent, nickel equivalent and instability factor values.

Samples of the above heats at 20%, 40% and 60% cold reduction stages were used for work hardening evaluations. These data are set forth in Table V.

Autogenous G.T.A. welds were made on the above series of heats, and the properties are reported in Table VI.

During the processing of the heats of Table III hot working problems were encountered with respect to heats A and B wherein heavy edge checking occurred during hot rolling. Magnetism readings were taken on each heat both in the as hot rolled and in the as-annealed condition with the following results:

| Heat | % Magnetism As Hot Rolled | As Hot Rolled and Annealed |
|---|---|---|
| A | 6 | 4 |
| B | 4 | 3 |
| C | 2 | 1 |

-continued

| Heat | % Magnetism As Hot Rolled | As Hot Rolled and Annealed |
|---|---|---|
| D | 1 | 0 |
| E | 0 | 0 |
| F | 0 | 0 |

The above magnetism values indicate that the edge checking of heats A and B was partially due to the presence of ferrite at hot rolling temperature. Heat C is marginal since it is preferred to have no ferrite present in the as hot rolled and annealed condition, in order to be completely free of edge checks. The lower carbon plus nitrogen levels and higher sum total of chromium, silicon and molybdenum of heats A and B in comparison to heats C, D, E and F were also factors in the occurrence of edge checking of heats A and B.

The room temperature mechanical properties set forth in Table IV indicate that all heats were comparable except for heat A which was slightly stronger than the remaining heats.

Table V indicates that the work hardening properties of all heats were similar except for heat A which appeared slightly stronger and harder. Elongation values showed little variation except that the more stable heats tended to have slightly higher values at low amounts of cold reduction. Magnetism readings indicated that the unstable heats A, B and C were slightly magnetic due to the retained ferrite from hot rolling.

In the weld tests reported in Table VI no cracking problems occurred. The data of Table VI indicate that the yield strengths did not differ significantly while the ultimate tensile strengths and elongation values varied directly with strain-hardening rates. Avoidance of hot cracking in welds of austenitic stainless steel cannot be assured by composition limitations since hot cracking can result from hot-tearing during solidification, formation of low melt-temperature eutectics and surface contamination. However, multi-pass welds which contain delta ferrite can develop chi phase and/or sigma phase in the as-welded state.

A further series of laboratory heats G–M was prepared and processed by the same routing set forth above with respect to heats A–F. Heat K was outside the present invention because of its low nitrogen content. Compositions are set forth in Table VII and room temperature mechanical properties are set forth in Table VIII. Intergranular corrosion resistance was measured by the Huey Test on several of the heats and on weldments thereof in the sensitized condition, and these results are summarized in Table IX.

Crevice corrosion resistance was evaluated by potentiodynamic tests with respect to heats D and F of the first series and heats G, J, K, L and M of the second series. These test results are summarized in Table X. Further tests have indicated that a molybdenum content of about 4% provides optimum pitting and crevice corrosion resistance in chloride-containing media.

The values reported in Table VIII indicate little difference in mechanical properties except for heat G which was slightly stronger, probably due to the formation of a small amount of deformation martensite. Progressive increases in the nitrogen content increased the annealed strength.

Annealed Olsen cup heights were measured in order to determine formability. Results indicate that formability was equivalent in all heats except heat K which contained only 0.10% nitrogen. Magnetism readings taken on the Olsen cups of each sheet indicated that heats G and K formed a small amount of deformation martensite during cup formation. This illustrates the necessity for proportioning the essential elements.

The intergranular corrosion resistance Huey test (in boiling 65% nitric acid) was performed with specimens in the as annealed plus 25 hours at 675° C. (1250° F.) sensitized condition and in the as welded plus 25 hours at 675° C. sensitized condition. The results reported in Table IX show that the nickel levels were sufficiently high and manganese low enough to inhibit formation of chi and/or sigma phases in the as annealed plus 25 hour sensitized material. The low carbon content of heat G apparently improved the Huey rate. After welding plus sensitizing, increased nickel contents appeared to improve Huey resistance somewhat, probably due to lower delta ferrite contents. A wrought commercial steel specimen in the as annealed plus 25 hours at 675° C. sensitized condition, in accordance with the above mentioned U.S. Pat. No. 3,592,634, was also subjected to this test, and it was destroyed. This is attributed to the presence of chi and/or sigma phases.

The crevice corrosion test reported in Table X was a dynamic current density scan on a potentiostat. The samples were discs prepolarized one hour prior to tests. Current densities were increased from 0.001 to 1 ma/cm$^2$. At 1 ma/cm$^2$ the scan was reversed. The test solution was deaerated 3.5% sodium chloride solution, pH 2, at 50° C.

The results reported in Table X indicate that the steels of the invention have far higher crevice corrosion resistance that AISI type 316 which cannot be tested in such environment. The higher manganese heats D and F exhibited lower crevice corrosion resistance than the other heats ranging between about 0.7 and 0.8% manganese.

Autogenous G.T.A. welds (argon shielding gas, which produces the greatest cracking tendency) were made on all steels of Table VII. No cracking problems were encountered. Magne-gauge readings indicate delta ferrite levels ranging from 1% to 12%. Welded Olsen cups were run on each of the specimens, and these values are set forth in Table XI. The Olsen values were similar to and slightly lower than those for the annealed steels, reported in Table VIII.

A final series of heats N–Q in accordance with the invention was prepared by processing the same as that set forth above. These compositions are set forth in Table XII.

After hot rolling the following observations were made:

| Heat | Edge Condition | % Magn. | % Ni | % Si + % Cr + % Mo |
|---|---|---|---|---|
| N | ½" checks | 3 | 12.63 | 25.88 |
| O | ¼" checks | 0 | 13.42 | 24.89 |
| P | no checks | 0 | 13.26 | 24.05 |
| Q | no checks | 0 | 13.43 | 24.77 |

Heat N contained delta ferrite which remained throughout processing with a 2% magnetism reading in the final product, due to the proportions listed above.

Mechanical properties of the cold rolled and annealed samples were comparable to those reported above for preceding heats.

Samples of these heats were subjected to further cold reduction of 70%, and tested for magnetism, which could result form deformation martensite. Heat N increased from 2% to 4% magnetism, but all the remaining heats O–Q had 0% magnetism.

Autogenous G.T.A. welds were attempted. Heats O, P, and Q exhibited hot cracking, the cracking in Heat P being so severe that no weld tests could be conducted. As welded tensile properties and weld percent magnetism are set forth in Table XIII. The weld strengths were about equivalent to those of the base metals although weld ductilities were somewhat lower. The tensile failure of the weld sample of heat N in the base metal indicates a heat affected zone which may have contained chi and/or sigma phases.

Intergranular corrosion resistance test were conducted and are reported in Table XIV. Excellent Huey rates were exhibited both in the as-sensitized and as-welded conditions, except for heat N in the sensitized condition. The higher Huey rate in this heat N sample also indicates the presence of chi and/or sigma phases.

The data reported above lead to the following conclusions:

Steels in accordance with the invention exhibit freedom from embrittlement in the cold-worked and stress-relieved condition and can be bent 180° around a 3/16 inch diameter mandrel. Similarly steels of the invention in the as-welded and cooled condition are free from embrittlement and suceptibility to accelerated corrosion resulting from chi and/or sigma phases in the heat affected zone.

TABLE III

| | Compositions - Weight Percent | | | | | | | | |
|---|---|---|---|---|---|---|---|---|---|
| Heat | C | Mn | S | Si | Cr | Ni | N | Mo | Cu |
| A | .016 | 1.00 | .022 | .54 | 22.80 | 11.86 | .18 | 2.47 | .24 |
| B | .017 | .97 | " | " | 22.79 | 12.08 | .19 | 2.46 | " |
| C | .022 | 1.25 | .021 | .42 | 22.57 | 12.15 | .21 | 2.28 | .20 |
| D | .023 | 1.22 | .020 | .41 | 22.54 | 12.41 | " | 2.30 | " |
| E | .032 | 1.43 | " | .26 | 22.18 | 12.40 | .23 | 2.08 | " |
| F | " | 1.41 | " | .27 | 22.08 | 12.61 | " | " | " |

All heats contained residual Cb (≦ 0.05%)

TABLE IV

| | Annealed Mechanical Properties | | | | | | |
|---|---|---|---|---|---|---|---|
| Heat | ksi (MPa) | ksi (MPa) | % Elong. 2" (50.8 mm) | Hardness $R_B$ | CrE | NiE | IF |
| A | 58.1 (400) | 110.2 (760) | 37.0 | 91.0 | 26.0 | 15.9 | −12.3 |
| B | 55.1 (380) | 109.5 (755) | 39.0 | 90.0 | 26.0 | 16.3 | −13.2 |
| C | 54.0 (372) | 106.6 (735) | 42.0 | 88.0 | 25.5 | 16.9 | −14.5 |
| D | 53.5 (369) | 106.0 (731) | 42.0 | 87.5 | 25.5 | 17.1 | −15.2 |
| E | 53.0 (366) | 106.6 (735) | 43.0 | 87.5 | 24.8 | 17.7 | −16.5 |
| F | 54.2 (373) | 106.2 (732) | 44.5 | 87.0 | 24.7 | 18.0 | −16.9 |

TABLE V

| | Cold Worked Mechanical Properties | | | | | |
|---|---|---|---|---|---|---|
| Heat | % CW | 2% Y.S. ksi (MPa) | U.T.S. ksi (MPa) | % Elong. 2" (50.8mm) | Hardness $R_{B/C}$ | % Mag |
| A | 0 | 58.1(400) | 110.2(760) | 37.0 | B91.0 | 0 |
| | 28.4 | 144.6(997) | 153.2(1056) | 8.0 | C34.5 | 6 |
| | 45.6 | 160.6(1107) | 172.7(1191) | 6.0 | C38.0 | 6.5 |
| | 63.4 | 176.0(1213) | 189.8(1308) | 5.0 | C41.0 | 6.5 |
| B | 0 | 55.1(380) | 109.5(755) | 39.0 | B90.0 | 0 |
| | 21.4 | 123.3(850) | 139.0(958) | 7.0 | C31.5 | 4 |
| | 43.2 | 155.0(1069) | 165.8(1144) | 6.0 | C38.5 | 4 |
| | 60.4 | 172.0(1186) | 183.5(1267) | 4.0 | C40.0 | 4 |
| C | 0 | 54.0(372) | 106.6(735) | 42.0 | B88.0 | 0 |
| | 17.2 | 114.8(792) | 129.0(890) | 21.0 | C28.0 | 1 |
| | 36.8 | 155.2(1070) | 165.3(1140) | 10.0 | C37.0 | 1 |
| | 58.8 | 172.3(1188) | 184.4(1271) | 6.0 | C40.0 | 1 |
| D | 0 | 53.5(369) | 106.0(731) | 42.0 | B87.5 | 0 |
| | 14.9 | 106.8(736) | 124.0(854) | 24.0 | C25.5 | 0 |
| | 35.6 | 149.2(1029) | 160.6(1108) | 10.0 | C36.0 | 0 |
| | 57.9 | 170.0(1172) | 182.4(1258) | 6.0 | C39.0 | 0 |
| E | 0 | 53.0(366) | 106.6(735) | 43.0 | B87.5 | 0 |
| | 17.1 | 113.5(782) | 129.4(892) | 22.0 | C28.5 | 0 |
| | 38.7 | 155.6(1074) | 165.2(1139) | 9.0 | C37.0 | 0 |
| | 58.4 | 171.6(1183) | 184.1(1270) | 7.0 | C40.0 | 0 |
| F | 0 | 54.2(373) | 106.2(732) | 44.5 | B87.0 | 0 |
| | 16.0 | 109.4(754) | 126.9(874) | 22.0 | C28.0 | 0 |
| | 37.9 | 156.4(1079) | 166.1(1146) | 7.5 | C37.0 | 0 |
| | 58.3 | 172.4(1188) | 185.2(1276) | 6.0 | C39.0 | 0 |

TABLE VI

| | G.T.A. Welded Properties | | | | |
|---|---|---|---|---|---|
| Heat | .2% Y.S. ksi (MPa) | U.T.S. ksi (MPa) | % Elong. 2" (50.8 mm) | Failure Location | Weld % Mag. |
| A | Not Tested | | | | 13 |
| B | Not Tested | | | | 11 |
| C | 56.0(386) | 108.0(745) | 29.5 | Weld | 7 |
| D | 54.2(374) | 106.2(732) | 31.5 | Weld | 5 |
| E | 54.2(374) | 104.2(718) | 28.0 | Weld | 0 |
| F | 54.2(374) | 102.2(705) | 23.5 | Weld | 0 |

TABLE VII

| | Compositions-Weight Percent | | | | | | | | | |
|---|---|---|---|---|---|---|---|---|---|---|
| Heat | % C | % Mn | % P | % S | % Si | % Cr | % Ni | % Mo | % N | % Cu |
| G* | .010 | .73 | .016 | .017 | .40 | 22.25 | 11.99 | 2.39 | .21 | .14 |
| H* | .015 | .80 | — | .018 | .45 | 22.48 | 12.49 | 2.28 | .20 | .16 |
| I* | " | .78 | — | " | .46 | 22.45 | 12.90 | 2.26 | .21 | " |
| J* | " | .76 | .025 | " | .44 | 22.31 | 13.45 | 2.25 | .20 | " |
| K | " | .80 | — | .017 | .44 | 22.25 | 13.46 | 2.33 | .10 | .17 |
| L* | .017 | .64 | — | .018 | .41 | 22.07 | 13.63 | 2.35 | .16 | .18 |
| M* | .019 | .74 | — | .017 | .40 | 22.54 | 13.39 | 2.36 | .20 | .17 |

All heats contained <0.05% Cb

*Steels of the present invention

TABLE VIII

| Heat | .2% Y.S. ksi (MPa) | U.T.S ksi (MPa) | % Elong. 2" (50.8mm) | Hard $R_B$ | Olsen Height in. (mm) | Olsen % Mag. | CrE | NiE | IF |
|---|---|---|---|---|---|---|---|---|---|
| | Mechanical Properties | | | | | | | | |
| | Mechanical Properties | | | | | | | | |
| G* | 62.4 (430) | 110.4 (762) | 39.0 | 90.0 | .410 (10.4) | 2 | 25.3 | 16.3 | −12.8 |
| H* | 58.8 (406) | 107.2 (739) | 41.0 | 89.0 | .430 (11.0) | 0 | 25.5 | 16.8 | −14.2 |
| I* | 54.6 (376) | 104.8 (723) | 42.5 | 87.5 | .440 (11.2) | 0 | 25.4 | 17.4 | −15.5 |
| J* | 57.1 (394) | 106.1 (732) | 43.0 | 87.0 | .400 (10.2) | 0 | 25.2 | 17.7 | −16.5 |
| K | 52.0 (358) | 100.7 (694) | 38.5 | 86.5 | .340 (8.6) | 1 | 25.3 | 15.9 | −13.1 |
| L* | 53.4 (368) | 101.9 (703) | 42.5 | 85.0 | .390 (9.9) | 0 | 25.1 | 17.2 | −15.5 |
| M* | 58.2 (402) | 107.0 (738) | 40.5 | 87.0 | .400 (10.1) | 0 | 25.6 | 17.8 | −16.7 |

*Steels of the present invention.

TABLE IX

| Heat | % Ni | Huey Rate Sensitized I.P.M. | (mmPM) | Welded + Sensitized Avg. I.P.M. | (mmPM) |
|---|---|---|---|---|---|
| G* | 11.99 | .0013 | (.033) | .0058 | (.147) |
| H* | 12.49 | .0064 | (.162) | .0051 | (.129) |
| I* | 12.90 | .0025 | (.063) | .0044 | (.112) |
| J* | 13.45 | .0054 | (.137) | .0031 | (.079) |

(Sensitization treatment - 25 hours at 675° C.)*Steels of the present invention

TABLE X

POTENTIODYNAMIC CREVICE CORROSION TESTS

| Heat | N | Ni | Potential to Initiate (mv) | Propagation Rate (mv/decade) |
|---|---|---|---|---|
| D* | .21 | 12.41 | +175/350 | 150 |
| F* | .23 | 12.61 | +138/325 | 150 |
| G* | .21 | 11.99 | +325/400 | 300 |
| M* | .20 | 13.39 | +250/438 | 275 |
| J* | .20 | 13.45 | +175/325 | 162 |
| L* | .16 | 13.63 | +150/300 | 100 |
| K | .10 | 13.46 | +150/412 | 75 |

*Steels of the present invention.

TABLE XI

Weld Olsen Cup Tests

| Heat | Olsen Height in | mm |
|---|---|---|
| G* | .370 | 9.4 |
| H* | .360 | 9.2 |
| I* | .340 | 8.6 |
| J* | .350 | 8.9 |
| K | .365 | 9.3 |
| L* | .340 | 8.6 |
| M* | .370 | 9.4 |

*Steels of the present invention.

TABLE XII

| Heat | C | Mn | S | Si | Cr | Ni | Mo | N | Cu |
|---|---|---|---|---|---|---|---|---|---|
| | Compositions-Weight Percent | | | | | | | | |
| N | .021 | .38 | .021 | .67 | 22.74 | 12.63 | 2.47 | .20 | .20 |
| O | .020 | .54 | .021 | .42 | 22.21 | 13.42 | 2.26 | .20 | .20 |
| P | .027 | .64 | .202 | .32 | 21.68 | 13.26 | 2.05 | .24 | .20 |
| Q | .020 | .53 | .018 | .43 | 22.09 | 13.43 | 2.25 | .17 | .52 |

All heats contained residual Cb (≦0.05%)

TABLE XIII

| Heat | .2% Y.S. ksi (MPa) | U.T.S. ksi (MPa) | % Elong. 2" (50.8mm) | Failure Location | Weld % Magn. |
|---|---|---|---|---|---|
| N | 53.4(368) | 106.5(734) | 28.5 | Base Metal & Weld | 11 |
| O | 52.3(360) | 95.0(655) | 19.0 | Weld | 1 |
| P | — | — | — | — | 0 |
| Q | 50.2(346) | 99.6(686) | 23.5 | Weld | ½ |

TABLE XIV

Intergranular Corrosion Resistance

| Heat | Condition | Huey Rate (avg. of five 48 hr periods) I.P.M. | μ mP γ |
|---|---|---|---|
| N | Sensitized* | .0024 | (735) |
| N | Welded | .0006 | (185) |
| O | Sensitized | .0008 | (227) |
| P | Sensitized | .0008 | (227) |
| Q | Sensitized | .0006 | (185) |

*One hour at 675° C.

We claim:

1. An austenitic stainless steel exhibiting high strength, good hot workability, good resistance against intergranular, pitting and crevice corrosion, and freedom from embrittlement both in the cold-worked and stress-relieved condition, and in the heat affected zone of weldments, said steel consisting essentially of, in weight percent, 0.06% maximum carbon, about 0.2% to 2.5% manganese, about 21.5% to 24.5% chromium, above 12% to about 16% nickel, about 0.20% to about 0.35% nitrogen, about 0.4% to about 0.7% silicon, about 2% to about 4% molybdenum, about 0.06% maximum phosphorus, about 0.04% maximum sulfur, up to about 0.6% columbium, with residual columbium when carbon is less than about 0.04% and columbium ranging from about 0.1% to 0.6% when carbon exceeds about 0.04%, and balance essentially iron.

2. The steel claimed in claim 1, consisting essentially of greater than about 0.04% to about 0.06% carbon, about 0.2% to 2.5% manganese, about 21.5% to 24.5% chromium, above 12% to about 16% nickel, about 0.20% to about 0.35% nitrogen, about 0.4% to about 0.7% silicon, about 2% to about 4% molybdenum, about 0.06% maximum phosphorus, about 0.04% maximum sulfur, about 0.1% to about 0.6% chromium, and balance essentially iron.

3. The steel claimed in claim 1, consisting essentially of 0.03% maximum carbon, about 0.2% to 2.5% manganese, about 21.5% to 24.5% chromium, above 12% to about 16% nickel, about 0.20% to about 0.35% nitrogen, about 0.4% to about 0.7% silicon, about 2% to about 3% molybdenum, about 0.06% maximum phosphorus, about 0.04% maximum sulfur, about 0.05% maximum columbium, and balance essentially iron.

4. Cold-worked and stress-relieved austenitic stainless steel having the composition of claim 1, and capable of being bent 180° around a 3/16 inch mandrel.

5. A welded article fabricated from the steel of claim 1, having substantial freedom from chi and sigma phases in the heat affected zone of the weld.

6. The steel claimed in claim 1, having a nickel equivalent of 16 to 19 calculated by the formula:

$$\%Ni+0.11\ (\%Mn)-0.0086\ (\%Mn)^2+0.41\ (\%Co)+0.44\ (\%Cu)+18.4\ (\%N)+24.5\ (\%C);$$

a chromium equivalent of 24 to 27 calculated by the formula:

$$\%Cr+1.21\ (\%Mo)+0.48\ (\%Si)+2.27\ (\%V);$$

and an instability factor of less than −14 calculated by the formula:

$$37.19-51.25\ (\%C)-2.59\ (\%Ni)-1.02\ (\%Mn)-0.47\ (\%Cr)-34.4\ (\%N).$$

* * * * *